United States Patent [19]

Shattuck et al.

[11] 4,396,305

[45] Aug. 2, 1983

[54] RIBBON CARTRIDGE HANDLING APPARATUS

[75] Inventors: Richard E. Shattuck; Francis R. Oakley, both of Cortland, N.Y.

[73] Assignee: SCM Corporation, New York, N.Y.

[21] Appl. No.: 227,333

[22] Filed: Jan. 22, 1981

[51] Int. Cl.[3] ..... B41J 33/14

[52] U.S. Cl. ..... 400/208; 400/144.2; 400/320

[58] Field of Search ..... 400/144.2, 194, 195, 400/196, 196.1, 207, 208, 208.1, 320

[56] References Cited

U.S. PATENT DOCUMENTS

| | | | |
|---|---|---|---|
| 3,513,957 | 5/1970 | Ricciardi et al. | 400/208 |
| 3,871,507 | 3/1975 | Perry et al. | 400/196.1 X |
| 3,904,015 | 9/1975 | Boyden et al. | 400/196.1 X |
| 3,904,017 | 9/1975 | Frechette | 400/196.1 |
| 3,990,563 | 11/1976 | Adamek et al. | 400/208 X |
| 4,111,293 | 9/1978 | Kockler et al. | 400/208 |
| 4,239,107 | 12/1980 | Boyatt, Jr. et al. | 400/208.1 X |
| 4,310,255 | 1/1982 | Asano et al. | 400/208 X |

FOREIGN PATENT DOCUMENTS

| | | | |
|---|---|---|---|
| 2757993 | 6/1979 | Fed. Rep. of Germany | 400/208 |
| 2901611 | 7/1980 | Fed. Rep. of Germany | 400/208 |
| 2306836 | 11/1976 | France | 400/208 |
| 55-114586 | 9/1980 | Japan | 400/208 |
| 55-114587 | 9/1980 | Japan | 400/208 |
| 55-146782 | 11/1980 | Japan | 400/208 |

OTHER PUBLICATIONS

Xerox Disclosure Journal, "Ribbon Cartridge Clamp," Frechette, vol. 1, No. 8, Aug., 1976, p. 31.

IBM Technical Disclosure Bulletin, "Cartridge Release Mechanism," Jenkins, vol. 22, No. 3, Aug. 1979, pp. 876–879.

IBM Technical Disclosure Bulletin, "Cartridge Latching", Treder, vol. 21, No. 8, Jan. 1979, pp. 3323–3324.

IBM Technical Disclosure Bulletin, vol. 23, No. 4, Sep. 1980, "Carrier for Ribbon Cartridge", Habich et al., pp. 1312–1314

*Primary Examiner*—Ernest T. Wright, Jr.

*Attorney, Agent, or Firm*—William E. Mear, III; Ernest F. Weinberger

[57] ABSTRACT

A ribbon cartridge handling apparatus has a pair of pivotal couplings for three position handling of a ribbon cartridge in a typewriter. The apparatus includes a cartridge receiving receptacle pivotally supported on a first pivot coupling on a rocker. A second pivot coupling on a frame support structure in the typewriter pivotally supports the rocker. A first operative position of the apparatus locates the receptacle in an open position for allowing insertion of the ribbon cartridge into the typewriter. A second operative position of the apparatus locates the receptacle together with the ribbon cartridge in a non-printing position located near a print station in the typewriter. The receptacle is operatively pivoted about the first pivot coupling between the first and second operative positions. A third operative position of the apparatus locates the rocker together with the receptacle carrying the ribbon cartridge in a print position at the print station in the typewriter. The rocker is pivoted by a lift mechanism in the typewriter for oscillating the ribbon cartridge about the second pivot coupling between the second and third operative positions. A latch device is provided on the rocker to operate in conjunction with features on the ribbon cartridge for releasably holding the ribbon cartridge on the receptacle.

3 Claims, 8 Drawing Figures

RIBBON CARTRIDGE HANDLING APPARATUS

SUMMARY OF THE INVENTION (1) Field of the Invention

This invention relates to devices used to facilitate positioning of a ribbon cartridge in a typewriter. More particularly, the present invention relates to a ribbon cartridge handling apparatus that is operable among three positions in the typewriter.

(2) Description of the Prior Art

The prior art discloses many varied and different devices for handling a cartridge in a machine utilizing a form of a cartridge. In cartridge machines, the cartridge is usually removeably mounted to permit interchange of individual cartridges. This application concerns handling apparatus used in conjunction with a printing machine, such as a typewriter, for positioning a ribbon containing cartridge therein. The term "ribbon cartridge handling", used in this application, refers to the manner in which a ribbon cartridge is manipulated by apparatus in the typewriter including facilitating interchange of ribbon cartridges as well as vibratory action of the ribbon cartridge for printing.

Heretofore, ribbon cartridge handling concepts have been restricted to either one or two operative positions for orientating a ribbon cartridge in a typewriter. An example of a single position cartridge handling construction having one stationary position in a typewriter is disclosed in U.S. Pat. No. 3,904,017, entitled "Ribbon Cassettes with Prethreaded Vibrator and Ribbon Feed Means", granted to Frechette on Sept. 9, 1975. In Frechette, like other single position cartridge handling devices, the cartridge mounting platform is fixed in the typewriter and remains stationary to accommodate interchanging of cartridges. When the cartridge is installed in the typewriter, an exposed portion of ribbon used for printing extends from the cartridge. The exposed ribbon rests vertically spaced from a print station to allow visual observation of previously typed work. A significant problem posed by a stationary mounting of the cartridge in that the exposed ribbon must be moved vertically relative to the fixed cartridge for ribbon placement at the print station for printing. Print movement is accomplished by a lift mechanism including a vibrator which necessitates the ribbon being threaded thereon. This is a time consuming and often messy operation. Moreover, if the vibrator is prethreaded and carried by the cartridge, as disclosed in Frechette, the cartridge itself is not only expensive, but the typewriter must be equipped with precision guide structure to carefully align the vibrator for operative connection with the lift mechanism. Another major disadvantage in a single position cartridge support is that the exposed portion of ribbon is subjected to compressional forces during printing oscillation. These compressional forces need to be compensated for to avoid stretch damage to the ribbon and to prevent the ribbon from creasing or folding.

An example of a two position ribbon cartridge handling device is disclosed in U.S. Pat. No. 3,990,563 entitled "Spool-Ejecting Ink Ribbon Device", granted to Adamek et al. on Nov. 9, 1976. In Adamek et al., a ribbon spool accepting device is pivotable between two positions. A first open position locates a holder for loading the spool and a second position locates the ribbon for printing. The holder pivots between the two positions. In the open position, the holder is swung upwardly to permit easy interchange of spools. When the holder is pivoted into the printing position, the ribbon is placed directly at the printing station. Thus, immediately typed characters are obscurred from view by the ribbon.

Another form of a two stage ribbon cartridge handling device is disclosed in U.S. Pat. No. 3,513,957 entitled "Ink Ribbon Cartridge for a Typewriter, Teleprinter or Similar Office Machine", granted to G. Ricciardi et al. on May 26, 1970. In Ricciardi et al., the cartridge is installed onto a plate which locates the printing portion of the ribbon near the printing station. The plate is vibrated on a pivot in and out of the print position at the printing station. A major disadvantage in this kind of two-stage cartridge handling system is that it lacks the capability of providing a convenient open position making interchange of the cartridge difficult. Accordingly, single and two stage cartridge handling devices of the prior art fail to completely satisfy all conditions for optimum performance with respect to permitting easy interchange of the cartridge, positioning the cartridge in the typewriter without having the ribbon block previously typed characters and vibrating the ribbon towards and away from the print station in a manner avoiding damage to the ribbon.

SUMMARY OF THE INVENTION

To overcome the problems and disadvantages found in the prior art, the present invention sets forth a ribbon cartridge handling apparatus equipped with two pivot couplings that independently operate for providing three position movement of a ribbon cartridge in a typewriter. The apparatus includes a rocker mounted on support structure in the typewriter and a receptacle for receiving a ribbon cartridge mounted on the rocker. A latch device is provided for securing the ribbon cartridge onto the receptacle. A first pivot coupling pivotally connects the receptacle on the rocker and a second pivot coupling pivotally connects the rocker on the support structure. A pair of springs urge the receptacle upwardly into a first or open position to allow easy unobstructed loading and unloading of the ribbon cartridge onto the receptacle. Once the cartridge is placed on the receptacle, it is manually pivoted about the first pivot coupling to rest in a second operative position wherein the cartridge is held on the receptacle by the latch device. In the second position, ribbon extending from the cartridge is located vertically spaced from the print station to permit unobscured observation of most recently typed work. A lift mechanism in the typewriter is operatively connected with the rocker for vibrating the rocker in a printing motion about the second pivot coupling. During printing motion the ribbon is carried towards and away from a third position at the print station for printing.

Accordingly, an object of the present invention is to provide a ribbon cartridge handling apparatus operable for positioning a ribbon cartridge in three different locations in a typewriter.

More specifically, it is an object of the present invention to provide a ribbon cartridge handling apparatus operable among three positions: a first operable position enables easy interchange of ribbon cartridges without substantial effort and without requiring complex loading instruction; a second operable position locates the ribbon in the typewriter in a manner whereby previously typed work is not blocked from view by the ribbon; and a third operable position places the ribbon at a print station for printing wherein vibratory print motion is accomplished without vertically moving the ribbon relative to its plane established in the cartridge and thus avoid crimping of the ribbon.

Other objects and many of the attendant advantages of this invention will be readily appreciated as the same becomes better understood by reference to the following detailed description when considered in connection with the accompanying drawing.

DESCRIPTION OF THE PREFERRED EMBODIMENT

Figure 1:
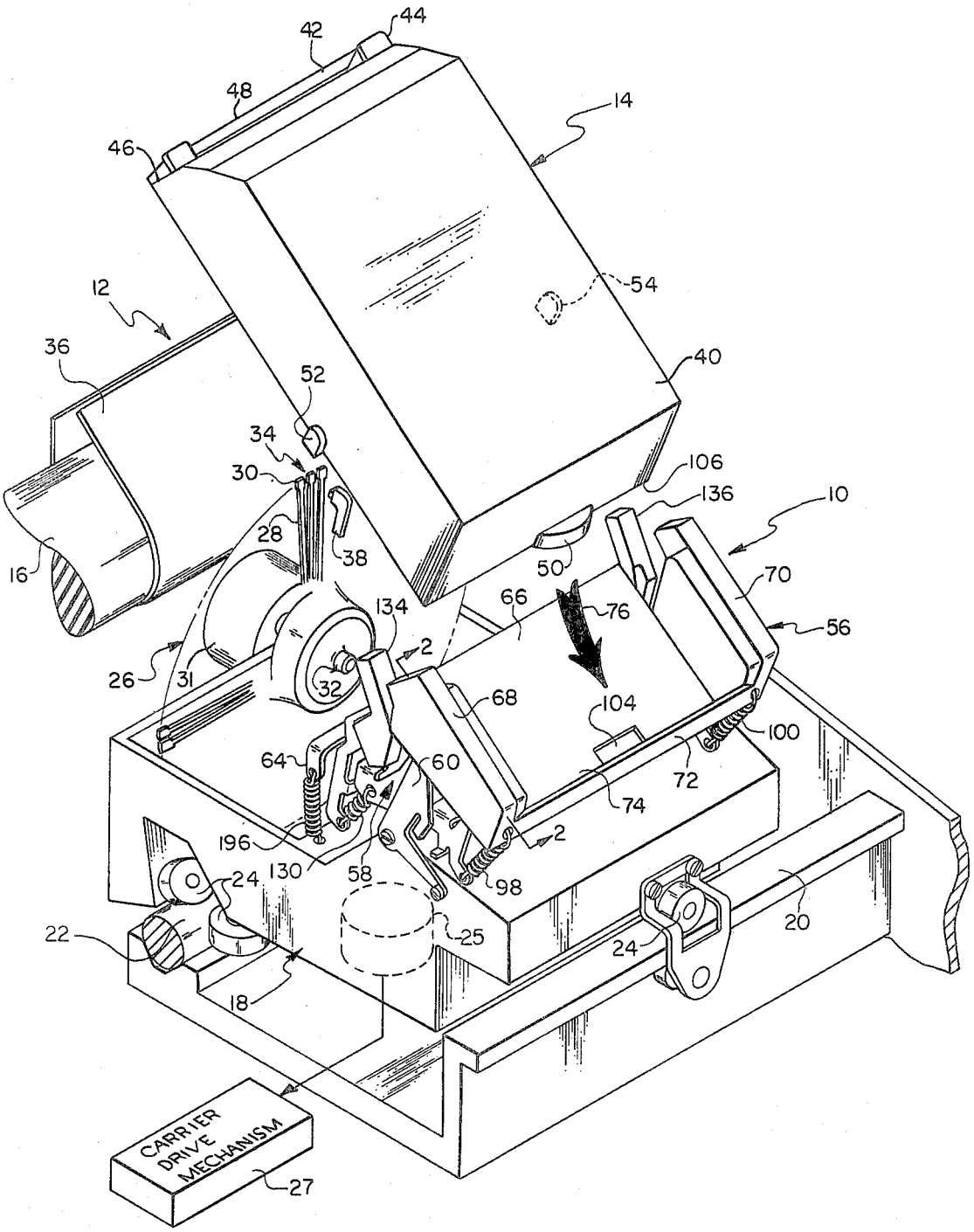
FIG. 1 is a perspective front view showing a ribbon cartridge handling apparatus built in accordance with the principle of this invention and assembled in a typewriter ready to receive a ribbon cartridge.

Referring to FIG. 1, there is shown a ribbon cartridge handling apparatus 10 built in accordance with the present invention and assembled in a typewriter 12 ready to receive a ribbon cartridge 14. Typewriter 12 is preferably of the kind having a laterally fixed platen 16 with a carrier 18 movably supported on a fixed beam 20 and a rod 22 by rollers 24 for movement along platen 16. A motor is represented by dashed lined cylinder 25 and is mounted on carrier 18 to power a suitably known kind of carrier drive mechanism, indicated by box 27, that couples carrier 18 to typewriter 12 for moving carrier 18 in either horizontal direction parallel to the platen 16. A print wheel 26 rotatably supported on carrier 18 has a plurality of radially extending petals 28. Each one of petals 28 carries at least one type character 30 embossed towards platen 16. Another motor 31, such as a stepper or servo, is used to rotatably drive print wheel 26 about a shaft 32 for locating a selected character 30 at a print station 34 aligned between paper 36 on platen 16 and an actuatable hammer 38.

The ribbon cartridge 14 employed for use in connection with the present invention is generally of the kind well-known in the art. A housing 40 in the form of a box-like container supports a ribbon 42 for movement from a supply area to a take-up storage area within housing 40. An exit and entrance opening 44, 46 on housing 40 permits a portion 48 of ribbon 42 to be carried external from housing 40 for print exposure. A front tab 50 and side projections 52 (left), 54 (right) are integrally formed features on housing 40 especially developed to coact with the present ribbon cartridge handling apparatus 10 for attaching the ribbon cartridge 14 in the typewriter 12, as discussed below.

Generally stated, ribbon cartridge handling apparatus 10 includes a receptacle 56 structured to receive ribbon cartridge 14 and a rocker 58 mounted on support arms 60, 62 (FIG. 3) fixed on sides of carrier 18. A latch device 64 is provided for releasably holding the ribbon cartridge 14 on the receptacle 56. Specific features and operation of the present ribbon cartridge handling apparatus 10 will now be described in a sequence comprising its normal use beginning with installing ribbon cartridge 14, securing ribbon cartridge 14 in the typewriter 12, printing motion and ribbon cartridge 14 removal.

INSTALLING RIBBON CARTRIDGE 14

Figure 2:
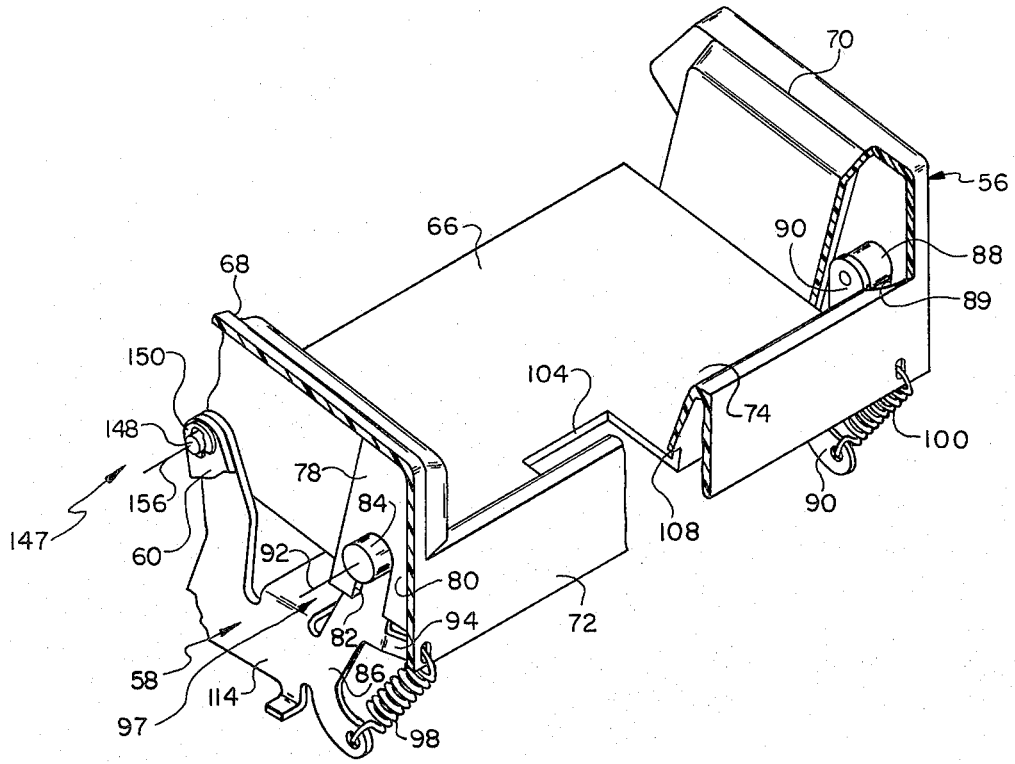
FIG. 2 is an enlarged front perspective view, in section along line 2—2 of FIG. 1, illustrating first and second pivot couplings arranged on one side of the present ribbon cartridge handling apparatus.

Referring to FIG. 2, receptacle 56 is preferably molded from a plastic material to economically form a base 66 with integral upstanding hollowed side walls 68, 70 and a hollowed front wall 72. An open cavity 74 is defined by an inward facing surfaces on walls 68, 70 and 72 which are spaced to freely receive ribbon cartridge 14 from a direction above receptacle 56 as approximately indicated by arrow 76 in FIG. 1.

Figure 3:
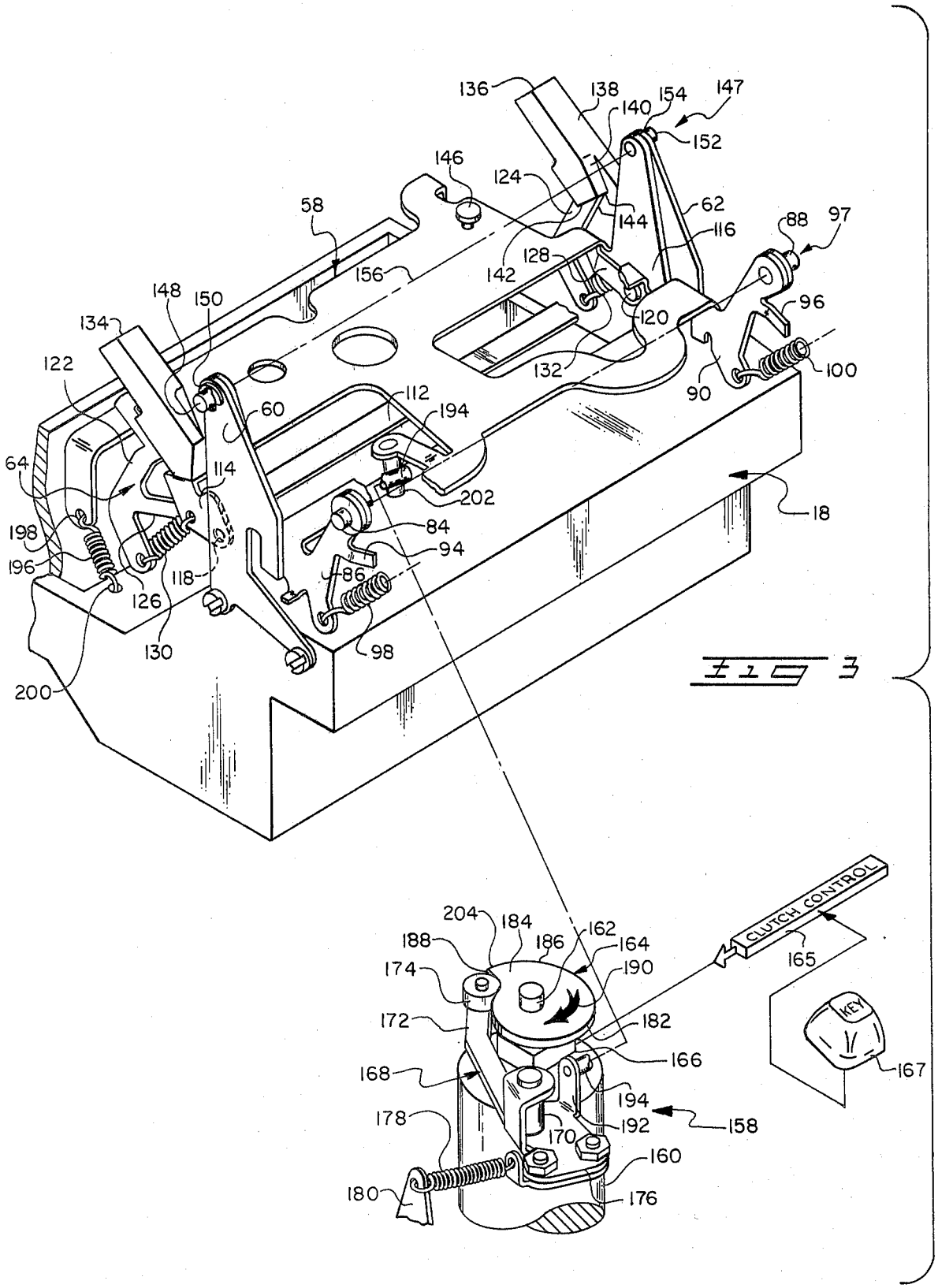
FIG. 3 is an enlarged front view in perspective showing a rocker portion of the present ribbon cartridge handling apparatus and showing an exploded relationship between the present ribbon cartridge handling apparatus and a known ribbon lift mechanism in the typewriter.

Receptacle 56 is pivotally supported on rocker 58 in a manner best illustrated in FIG. 2 wherein only one side (left) is clearly shown with the other side (right) understood to contain a similar pivotal arrangement. An internal rib 78 is centrally located within hollowed side wall 68 and is integrally attached with an inside surface 80 of front wall 72. An open-end slot 82 pivotally receives a pivot pin 84 fixedly mounted on an end 86 of rocker 58. In FIGS. 2 and 3, another pivot pin 88 is shown fixedly mounted on an ear 90 of rocker 58. Pivot pins 84 and 88 are in axial alignment thereby forming axis 92 about which receptacle 56 pivots. Pivot pin 84 in open-end slot 82 together with pivot pin 88 in its slot 89 (FIG. 2) on receptacle 56 form a first pivot coupling 97 of the present ribbon cartridge handling apparatus 10.

Figure 4:
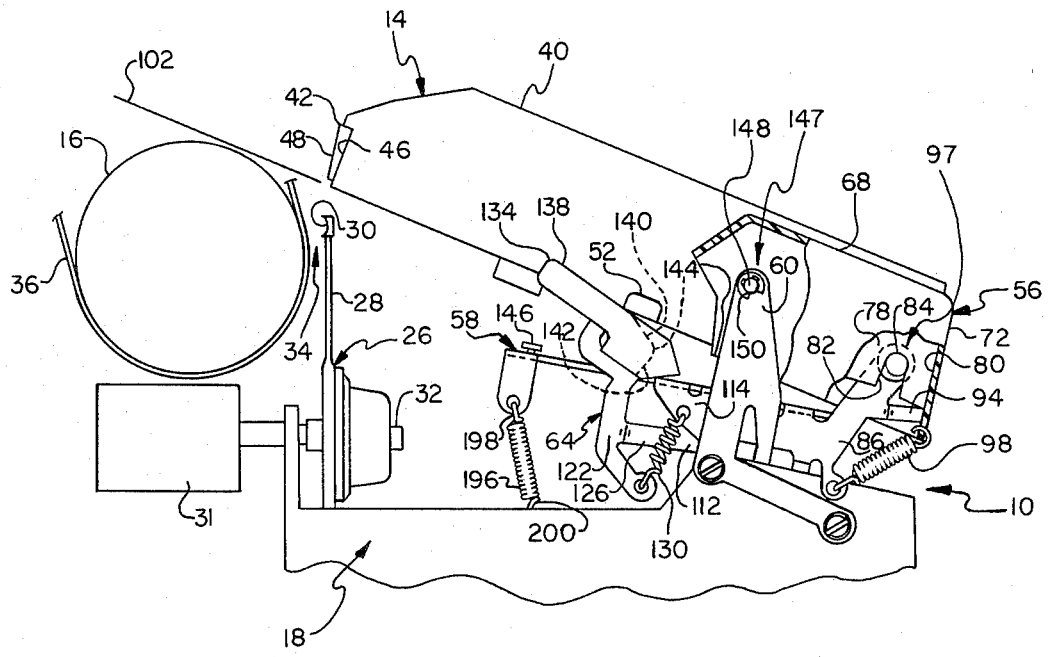
FIG. 4 is a left side elevational view illustrating a first or open position of the present ribbon cartridge handling apparatus with a ribbon cartridge resting in the typewriter.

A first operative position of the ribbon cartridge handling apparatus 10 is an open position shown in FIGS. 1, 2 and 4 wherein receptacle 56 extends angularly upward for enabling easy unobstructed insertion of ribbon cartridge 14 onto receptacle 56. FIG. 4 illustrates ribbon cartridge 14 resting on receptacle 56 in the open position.

The open position is established by a stop projection 94 on end 86 and a stop projection 96 (FIG. 3) on an end 90 held in abutment with inside surface 80 of front wall 72 through the urging of springs 98, 100 extending between front wall 72 and ends 86 and 90, respectively. In the open position, receptacle 56 angularly extends upward to form an acute angle in relation to the substantially horizontal plane established by rocker 58. The exact acute angle is not critical, however, it is desirable to have, e.g., an imaginary line 102 in FIG. 4 extending straight outwardly from the bottom of ribbon cartridge 14 just above platen 16. This position allows easy insertion of cartridge 14 and may be adjusted by bend forming stop projections 94, 96. Additionally, stop projections 94 and 96 may be individually adjusted to align them for simultaneous contact with inside surface 80.

To install or load ribbon cartridge 14 on receptacle 56, the operator simply orientates the ribbon cartridge 14 as shown in FIG. 1 and moves it towards receptacle 56 from the direction indicated by arrow 76. Cartridge front tab 50 is located within an aperture 104 (FIG. 2) centrally located through base 66 and extending partially upward on front wall 72 of receptacle 56. A front corner 106 of housing 40 engages a corner 108 where front wall 72 joins base 66, thus, limiting forward movement of ribbon cartridge 14 in the receptacle 56. Ribbon cartridge 14 is pivoted downward within receptacle 56 about corner 108 until housing 40 rests on base 66 with tab 50 positioned within aperture 104.

SECURING RIBBON CARTRIDGE 14

Latch device 64 is assembled on rocker 58 and coacts with side projections 52, 54 for fixedly holding ribbon cartridge 14 in place on receptacle 56. As best shown in FIG. 3, latch device 64 includes a formed lever 112 mounted on ends 114 and 116 of rocker 58 for pivotal movement about pivots 118, 120. Ends 122 and 124 are connected with lever 112 by outwardly formed arms 126 and 128, respectively. A spring 130 extends between end 122 of lever 112 and end 114 of rocker 58. Another spring 132 extends between end 124 of lever 112 and end 116 of rocker 58. Together, springs 130 and 132 urge lever 112 in a clockwise direction (FIG. 4) about pivots 118, 120 limited by arms 126, 128 in contact with rocker 58.

A latch button 134 is fixedly mounted on the upper end of end 122. A second latch button 136 is likewise fixed on the other end 124. Latch buttons 134, 136 are constructed in mirror fashion to include similar features, therefore, only features contained on one latch button 136 are explained in detail with reference to FIGS. 7 and 8 wherein similar features on latch button 134 are likewise understood and numbered. A flat top surface 138 of latch button 136 is joined with an angular cam surface 140. A lock surface 142 is joined with cam surface 140 at a junction 144.

Figure 7:
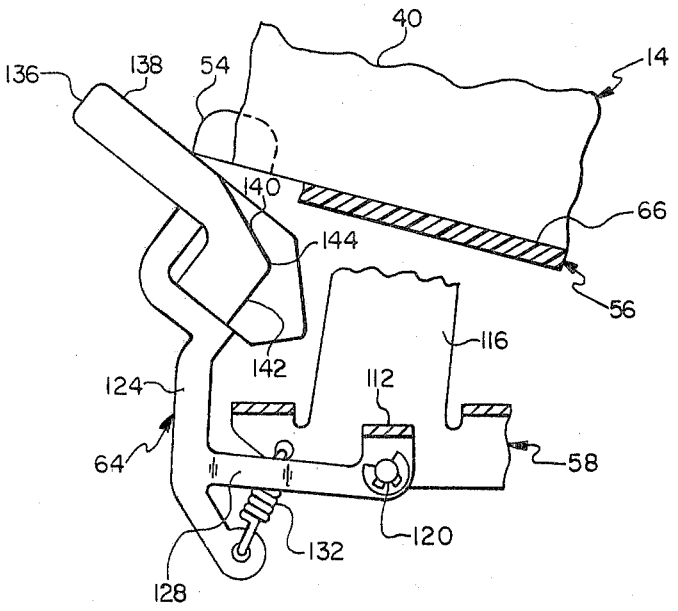
FIG. 7 is an enlarged left side elevational view in section showing a portion of a latch device in an unlocked position with a portion of the ribbon cartridge resting in the open position of FIG. 4.
Figure 8:
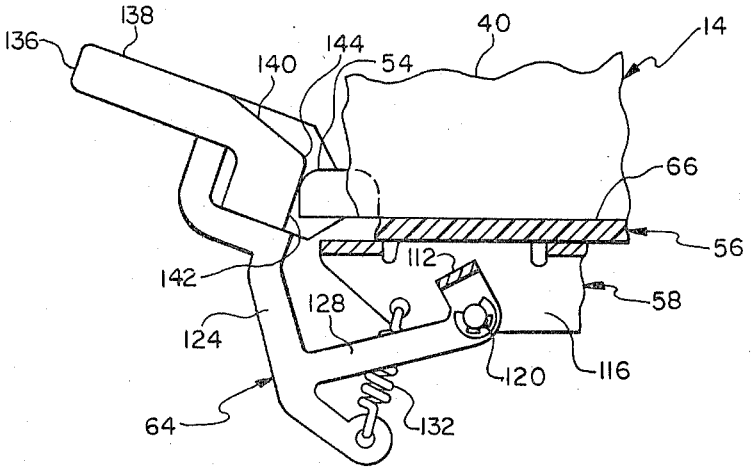
FIG. 8 is a view similar to FIG. 7 showing the latch device in a locking position holding the ribbon cartridge.

In FIG. 7, a portion of ribbon cartridge 14 near latch device 64 is shown in the open position. Side abutment 54 on housing 40 is engaged with the flat top surface 138 at a location just behind cam surface 140. To secure ribbon cartridge 14 in the present ribbon cartridge handling apparatus 10, ribbon cartridge 14 is manually tilted downward by pressing on the top of the housing 40 at a convenient location rearward from pivot axis 92 of coupling 97 (FIG. 4). This action causes receptacle 56 to pivot (counterclockwise) with ribbon cartridge 14 about axis 92 formed by the first pivot coupling 97. Cartridge 14 on receptacle 56 pivots as a unit against the pull of springs 98, 100. As ribbon cartridge 14 moves downward from the open position of FIG. 4, towards a rest position shown in FIG. 5, side abutments 52, 54 engageably slide along top surface 138 of buttons 134, 136 onto cam surface 140. Sliding action along top surface 138 and cam surface 140 causes lever 112 to swing rearwardly (counterclockwise) about pivots 118, 120 against the urging of springs 130 and 132. When the side abutments 52 and 54 pass junction 144 and disengage from cam surface 140, springs 130 and 132 are allowed to restore towards their relaxed state thereby pulling lever 112 clockwise about pivots 118, 120. This sudden release of spring energy causes ribbon cartridge 14 to move rapidly downward in a snap action. An abutment button 146 (FIGS. 3 and 4) extends upwardly from rocker 58 for contact with the under surface of housing 40 to limit downward motion of ribbon cartridge 14.

Figure 5:
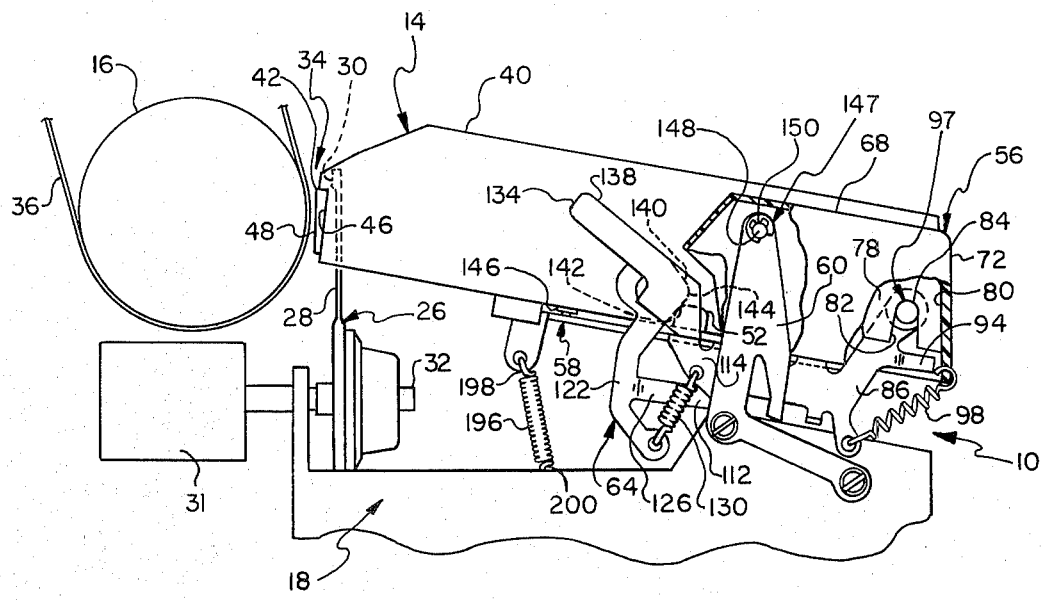
FIG. 5 is a view similar to FIG. 4 showing a second position of the present ribbon cartridge apparatus wherein ribbon extending from the ribbon cartridge rests just below a print station in the typewriter.

FIG. 5 illustrates a second position of the present ribbon cartridge handling apparatus 10 which corresponds to the normal rest position for the ribbon cartridge 14 in the typewriter 12. The rest position is defined by ribbon cartridge 14 in contact with abutment button 146 and held there through the tensioning of springs 130, 132 causing lock surface 142 of button 134, 136 to bear downwardly upon side abutments 52, 54 shown in part in FIG. 8. Thus, ribbon cartridge 14 is effectively latched in the rest position with springs 98, 100 on the receptacle 56 extended.

PRINTING MOTION

In the rest position of FIG. 5, ribbon cartridge 14 is positioned with the exposed portion 48 of ribbon 42 situated slightly below print station 34. Thus, the ribbon portion 48 normally rests below a typing line appearing on the paper 36 for allowing the typist visual observation of previously typed characters. In order for printing to occur, the ribbon portion 48 must be displaced (elevated) from rest to a position shown in FIG. 6 wherein ribbon portion 48 is located at the print station 34 situated between a print character 30 on a selected petal 28 and paper 36 on platen 16. This is a third operative position of the present ribbon cartridge handling apparatus 10 and corresponds with a print position. A complete print motion cycle includes moving the ribbon portion 48 from rest (FIG. 5) to the elevated print position of FIG. 6 and return.

Printing motion occurs through rocking motion of rocker 58 pivotally mounted on support arms 60, 62 via a second pivot coupling 147 in the ribbon cartridge handling apparatus 10. Referring once again to FIG. 3, the second pivot coupling 147 includes a pivot pin 148 fixed on end 114 of rocker 58 extending through a circular opening 150 on support arm 60. A second pivot pin 152 is fixed on end 116 of rocker 58 and extends through a circular opening 154 on support arm 62. Pivot pins 148 and 152 of the second pivot coupling 147 are in axial alignment, thus, forming a common axis 156 about which rocker 58 pivots.

A suitably known lift mechanism 158 is employed in typewriter 12 for effecting tilting motion of rocker 58 about axis 156. Lift mechanism 158 is powered by a motor 160 of known construction mounted on carrier 18 for rotatably driving a connected shaft extension 162. A cam disk 164 is freely supported on shaft 162. A suitably operable clutch device, illustrated by box 166, is fixedly mounted on shaft 162 and operable for coupling cam disk 164 with shaft 162 for powered rotation therewith in response to commands received from a known remote clutch control 165 used to selectably actuate clutch device 166. A cam follower 168 is pivotally mounted on pivot stud 170 fixed on carrier 18. An arm 172 of cam follower 168 extends towards cam disk 164 and rotatably supports a roller 174. An opposing arm 176 of cam follower 168 is formed upwardly for hook connection of a spring 178 extending from a mount 180 on the carrier 18. Spring 178 urges roller 174 into contact with a cam surface 182 on cam disk 164. Cam surface 182 is profiled with at least one rise lobe 184 having a leading gradual rise portion 186 for swinging cam follower 168 away from shaft 162 against the pull of spring 178 and a fall portion 188 for returning cam follower 168 onto surface 182, under the pull of spring 178 when cam disk 164 is rotated. It will be understood, cam disk 164 is driven to rotate clockwise as indicated by arrow 190 when coupled with clutch device 166. A third arm 192 is formed upwardly and fixedly carries an abutment stud 194.

A spring 196 has one end 198 connected on rocker 58 and its other end 200 is anchored on carrier 18 for urging rocker 58 counterclockwise about the second pivot coupling 147 along axis 156. A stud 202, similar to abutment stud 194, extends downwardly from beneath rocker 58 for engagement with the front of stud 194 of lift mechanism 158. Accordingly, rest position of FIG. 5 is defined by spring 196 engaging stud 202 with abutment stud 194 which, in turn, is limited by roller 174 in contact with cam surface 182 through the urging of spring 178.

Figure 6:
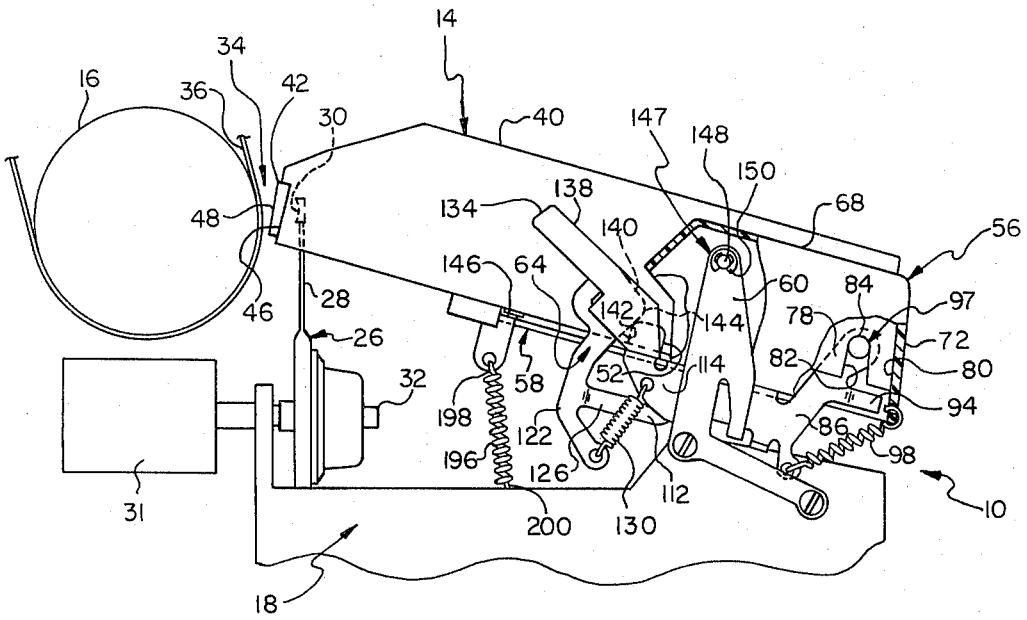
FIG. 6 is a view similar to FIGS. 4 and 5 showing a third position of the present ribbon cartridge apparatus wherein ribbon is placed at the print station for printing.

In operation, to move ribbon cartridge handling apparatus 10 from its rest position of FIG. 5 to the third or print position of FIG. 6, clutch device 166 is selectively activated by remote command function of clutch control 165 from, e.g., depressing a character key 167 (FIG. 3) associated with typewriter 12. This couples cam disk 164 to rotate (clockwise) with shaft extension 162 of motor 160. Cam follower 168 swings counterclockwise about pivot stud 170 thereby extending spring 178 as roller 174 rides along the rise portion 186 of lobe 184. Stud 194 engageably drives stud 202 rearwardly causing rocker 58 to pivot about the second pivot coupling 147 against the pull of spring 196. This tilting displacement of rocker 58 carries receptacle 56 and ribbon cartridge 14 as a unit moving ribbon portion 48 in a substantially upward vertical direction toward print station 34. Once roller 174 reaches a high position 204 on lobe 184, ribbon portion 48 is elevated to a position aligned at print station 34 for printing. Ribbon portion 48 may be retained momentarily t a print station 34 to allow completion of the print stroke from hammer 38. This will avoid print smudging by preventing relative sliding motion from occuring between ribbon portion 48 and type character 30 during printing. Ribbon delay at the print station 34 may be accomplished in any suitable fashion, such as, e.g., a latch system or an extended dwell on high portion 204 of lobe 184.

Return of the ribbon cartridge handling apparatus 10 from print position occurs when roller 174 leaves high portion 204. Fall portion 188 of lobe 184 is then exposed to roller 174 and urged by spring 178 cam follower 168 is restored onto cam surface 182. Spring 196 urges rocker 58 in a counterclockwise direction about pivot axis 156 of the second pivot coupling 147 causing stud 202 to remain in engagement with stud 194 thereby allowing ribbon cartridge 14 to fall towards rest position.

RIBBON CARTRIDGE 14 REMOVAL

To release ribbon cartridge 14 from the hold applied by latch device 64 as is shown in FIG. 5, the operator simply presses downwardly on the flat top surface 138 of one or both latch buttons 134, 136. This action pivots lever 112 counterclockwise against the pull of springs 130, 132. As a result, lock surface 142 on latch buttons 134, 136 is moved away from their holding engagement with side projections 52, 54 of ribbon cartridge 14. Once the side projections 52, 54 are freed, receptacle 56 quickly snaps to the open position of FIG. 4, wherein receptacle 56 extends upwardly as a result of being pivoted about the first pivot coupling 97 under the urging of springs 98, 100. Ribbon cartridge 14 is now in a position enabling the operator to easily grasp housing 40 of ribbon cartridge 14.

In summary, by constructing a ribbon cartridge handling apparatus 10 in accordance with the foregoing arrangement of components movable about the disclosed two pivot couplings 97, 147, ribbon cartridge 14 is positionable in three different operative positions for enhancing use of cartridge 14 in a typewriter 12.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A ribbon cartridge handling apparatus for positioning a ribbon cartridge in a printing machine having a printing station, a print carrier frame and a ribbon lift mechanism, the ribbon cartridge handling apparatus comprising:

a rocker mounted for reciprocal movement on the print carrier frame;

a receptacle supporting the ribbon cartridge;

a first pivotal coupling means, for coupling said receptacle to said rocker for pivotal movement of said receptacle relative to said rocker;

a latching means mounted on said rocker for latching the ribbon cartridge to said receptacle and for abutting said receptacle against said rocker for movement therewith;

a second pivotal coupling means for connecting said rocker to the print carrier frame;

means including a first spring connecting the ribbon lift mechanism to said rocker for pivoting said rocker and said receptacle about said second pivotal coupling means to reciprocate the ribbon cartridge between a rest position below a print point and a print position; and a second spring connected between said rocker and said receptacle for pivoting said receptacle relative to said rocker about said first pivotal coupling means in response to releasing said latching means to pivot the ribbon cartridge from the rest position to an open position above the print point to accommodate loading and unloading the ribbon cartridge from said receptacle.

2. The ribbon cartridge handling apparatus according to claim 1 further comprising a projection formed on the ribbon cartridge and wherein said latching means includes a latch button pivotally attached to said rocker and engages said projection when said receptacle abuts against said rocker for latching the ribbon cartridge to said receptacle and for holding said receptacle abutted against said rocker for movement therewith.

3. The ribbon cartridge handling apparatus according to claim 1 wherein said first spring is connected between said rocker and the print carrier frame for holding said rocker stationary while said second spring pivots said receptacle relative to said rocker to pivot the ribbon cartridge to said open position.

* * * * *